United States Patent [19]

Jeambey

[11] 4,193,448

[45] Mar. 18, 1980

[54] APPARATUS FOR RECOVERY OF PETROLEUM FROM PETROLEUM IMPREGNATED MEDIA

[76] Inventor: Calhoun G. Jeambey, 7485 E. Kenyon Ave., Denver, Colo. 80237

[21] Appl. No.: 941,122

[22] Filed: Sep. 11, 1978

[51] Int. Cl.[2] ..... E21B 43/24

[52] U.S. Cl. ..... 166/60; 166/65 R; 166/248; 219/278

[58] Field of Search ..... 166/60, 248, 257, 65 R; 219/105.5 R, 105.5 A, 277, 278

[56] References Cited

U.S. PATENT DOCUMENTS

| | | | |
|---|---|---|---|
| 2,685,930 | 8/1954 | Albaugh | 166/248 UX |
| 2,757,738 | 8/1956 | Ritchey | 166/248 |
| 3,123,141 | 3/1964 | Towell et al. | 166/60 |
| 3,133,592 | 5/1964 | Tomberlin | 166/60 |
| 3,170,519 | 2/1965 | Haagensen | 166/60 |

FOREIGN PATENT DOCUMENTS

| | | | |
|---|---|---|---|
| 2427031 | 12/1975 | Fed. Rep. of Germany | 166/248 |
| 1307808 | 9/1962 | France | 166/248 |

*Primary Examiner*—Stephen J. Novosad
*Attorney, Agent, or Firm*—Zarley, McKee, Thomte, Voorhees & Sease

[57] ABSTRACT

A method and apparatus for the recovery of petroleum from petroleum impregnated media. The apparatus includes a microwave generator and a guide for directing microwaves to a microwave dispersing chamber for heating the media. The apparatus has a plurality of holes for the flow of heated petroleum into a petroleum chamber. The method of the invention includes inserting the apparatus into an opening in the media, dispersing microwaves into the media to heat it and recovering petroleum in the recovery chamber.

6 Claims, 2 Drawing Figures

APPARATUS FOR RECOVERY OF PETROLEUM FROM PETROLEUM IMPREGNATED MEDIA

BACKGROUND OF THE INVENTION

This invention relates generally to petroleum recovery apparatus and more particularly to a microwave apparatus for the recovery for petroleum from petroleum impregnated rock, shale and sands.

The only known method for recovering oil from oil bearing shale is to heat the shale by steam or hot water and to extract the oil from the water and oil recovered in the process. The energy required to heat the shale by known methods is so great that these methods are impractical and economically unfeasible for the commercial production of oil.

Additional problems associated with known methods for the recovery of oil from shale and the like are the difficulty and expense of providing heated steam or water at the mining site. Associated with strip mining and other methods presently used or contemplated for shale oil mining is the resultant devastation of the landscape. The environmental impact therefore makes these methods unacceptable.

Accordingly, a primary object of the present invention is to provide an improved method and apparatus for the recovery of petroleum from petroleum impregnated media.

A further object is to provide a petroleum recovery method and apparatus wherein a petroleum impregnated media is heated by microwaves.

A further object is to provide a microwave petroleum recovery apparatus which is insertable into drilled holes in a petroleum impregnated media.

A further object is to provide a microwave petroleum recovery method and apparatus which may be used without damage to the environment.

Finally, a further object is to provide a microwave petroleum recovery method and apparatus which is practical, economical and efficient.

SUMMARY OF THE INVENTION

This invention provides a practical method and apparatus for extracting and recovering the vast quantities of oil found in shale deposits. The apparatus includes an elongated shell containing a microwave generator, a microwave dispersing chamber and a petroleum recovery chamber. Microwaves are guided from the generator to the dispersing chamber for dispersal into a petroleum impregnated media to heat the same. The heated petroleum flows through holes in the shell into the petroleum recovery chamber for removal from the media. Since the microwave generator is electrically activated, it is only necessary to conduct electrical energy to the mining site as opposed to the heated steam or water required by known methods. The application of microwaves for heating oil bearing shale, rock and sands is safe, cost efficient and at least as fast as other presently known methods for the recovery of oil from shale.

Finally, the method and apparatus of the present invention enable the recovery of petroleum from shale, rock and sands with no appreciable environmental impact. Since the apparatus of the invention is simply insertable into drilled holes, there is no substantial alteration of the landscape. Furthermore, the amount of energy required to heat petroleum impregnated media by microwaves is substantially less than the energy requirements of conventional heating methods.

DESCRIPTION OF THE PREFERRED EMBODIMENT

Figure 1:
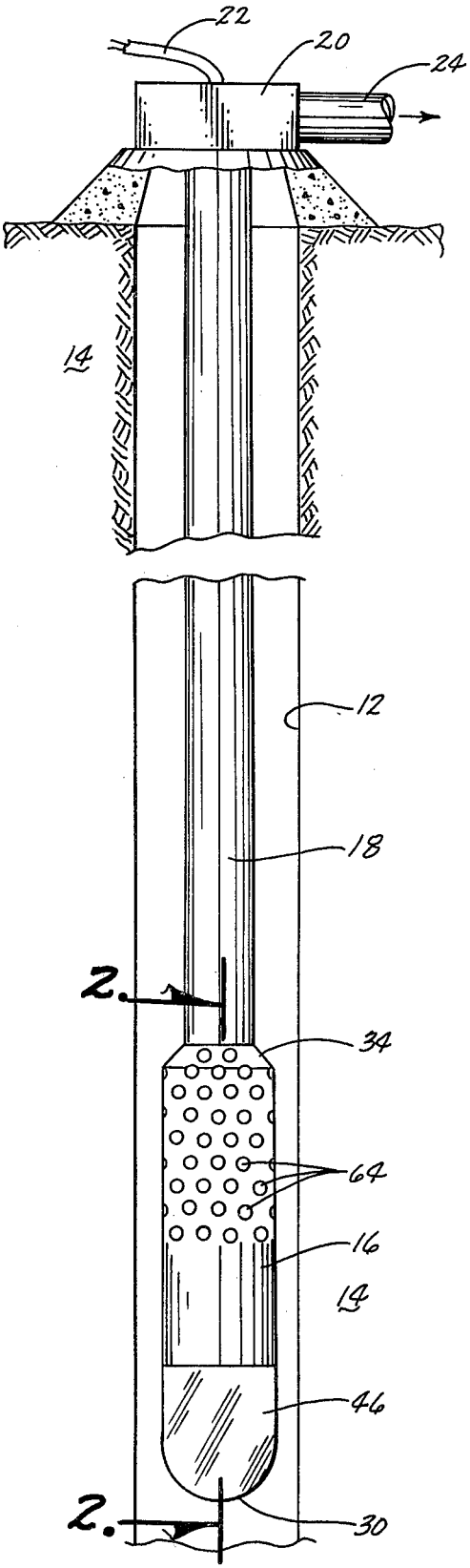
FIG. 1 is a side elevational view of the microwave petroleum recovery apparatus of the invention positioned within a drilled hole in a petroleum impregnated media.

The apparatus 10 of the present invention is shown in FIG. 1 positioned within a drilled hole 12 in a petroleum impregnated media 14 such as shale, rock or sands. The apparatus includes an elongated shell 16 connected by an oil conduit 18 to a housing 20 situated externally of the drilled hole 12. Electrical power is supplied to the housing 20 from a power source (not shown), through a lead wire 22. Petroleum is delivered from the apparatus through a supply conduit 24 extended from the housing 20.

Figure 2:
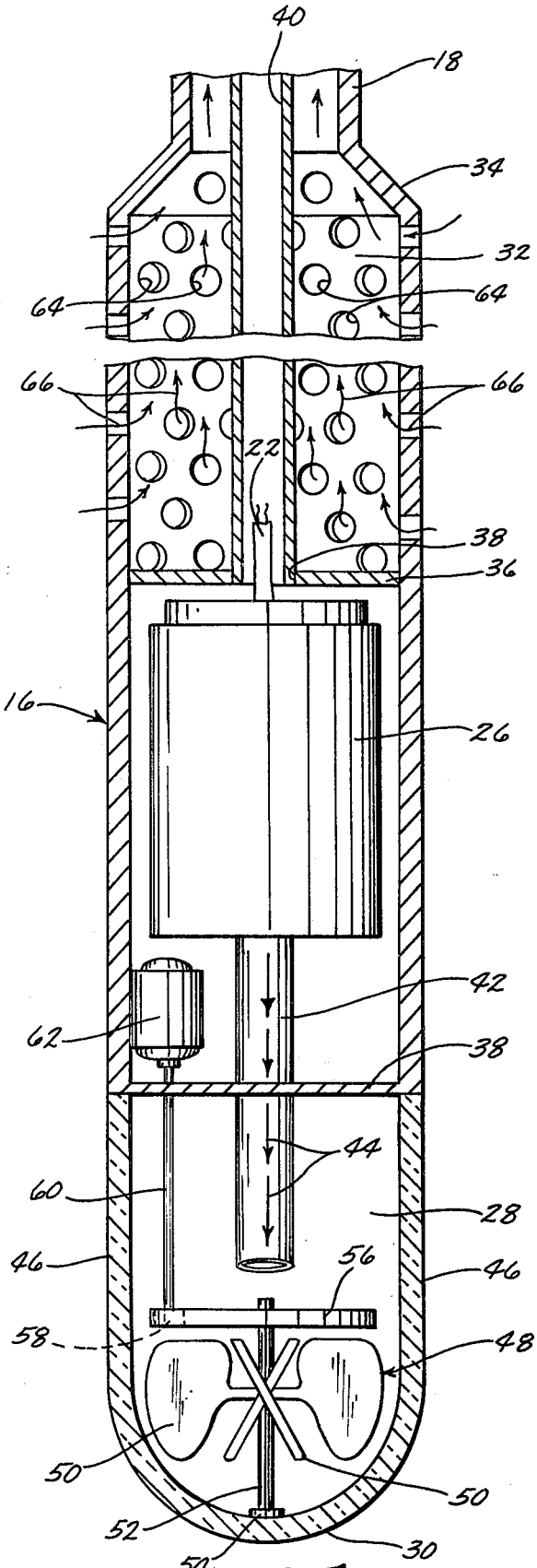
FIG. 2 is a sectional view of the apparatus as seen on line 2—2 of FIG. 1.

Referring to FIG. 2, it can be seen that shell 16 includes a microwave generator 26 disposed centrally between a microwave dispersing chamber 28 at the leading end 30 of shell 16 and a petroleum chamber 32 at the trailing end 34 of shell 16.

Microwave generator 26 is a high voltage magnatron tube supported by any suitable means between spaced apart divider walls 36 and 38. Divider wall 36 has a central opening 38 into which one end of a high voltage electrical conduit 40 is fitted in sealed relation. It can be seen that the lead wire 22 extends through conduit 40 for supplying electrical power to the high voltage magnatron tube 26.

Microwaves generated by the magnatron tube 26 are directed through a tubular microwave guide 42 as indicated by arrows 44 into the dispersing chamber 28. It can be seen that microwave guide 42 extends through divider wall 38.

Microwave dispersing chamber 28 is enclosed within an inert or microwave transparent end portion 46 of shell 14.

A microwave mixing device 48 is supported within dispersing chamber 28 forwardly of microwave guide 42. Mixing device 48 includes a plurality of deflector blades 50 carried on a central shaft 52 which is rotatably secured within a bearing 54 such that the shaft 52 is coaxially positioned within the microwave transparent shell portion 46.

To rotate blades 50 of mixing device 48, a driven wheel 56 is fixed onto the end of shaft 52 for rotation therewith. Wheel 56 is driven by a drive wheel 58 on the end of an output shaft 60 of an electric motor 62 mounted within shell 16 rearwardly of divider wall 38. Output shaft 60 thus extends through wall 38 with freedom of rotation relative to the wall.

Petroleum recovery chamber 32 is defined as that space which is disposed between electrical conduit 40 and shell 16 rearwardly of divider wall 36. Shell 16 is perforated by a plurality of holes 64 for the communication of petroleum from the media 14 into the recovery chamber 32 as indicated by arrows 66.

The trailing end 34 of shell 16 is tapered for connection to the lower end of oil conduit 18.

In operation, the hole 12 is drilled in petroleum impregnated media such as rock, shale and sands and the apparatus 10 is inserted into the drilled hole 12 to the extent that housing 20 is supported at the top of the hole with shell 16 suspended therefrom. The high voltage magnatron tube 26 is then energized to direct microwaves through guide 42 to the microwave mixing device 48. Drive motor 62 is energized to rotate mixing device 48 which causes the microwaves to be dispersed from chamber 28 through the microwave transparent shell portion 46 and into the media 14. The media 14 is thus heated with the result that heated petroleum drains into drilled hole 12.

Shell 16 is preferably moved up and down or otherwise so that it is not static in order to facilitate both the dispersal of microwaves into media 14 and the recovery of oil into recovery chamber 32. The oil which enters recovery chamber 32 through holes 64 is drawn upwardly through oil conduit 18 for removal through the supply conduit 24 to a reservoir or the like.

To provide for movement of shell 16 during the recovery process, oil conduit 18 may be rotatably and slidably supported on housing 20 and connected to a suitable mechanical drive apparatus for moving the shell 16 and oil conduit 18 in unison.

Whereas microwave mixing device 48 is shown as including a plurality of blades 50, other known devices for mixing, spreading or otherwise dispersing microwaves may be utilized.

Thus there has been shown and described a method and apparatus for the recovery of petroleum from petroleum impregnated media which accomplishes at least all of the stated objects.

I claim:

1. An apparatus for the recovery of petroleum from petroleum impregnated media having an opening therein, comprising, an elongated shell for insertion into said opening, said shell having a trailing end and a leading end, and being connected at its trailing end to an oil passage conduit said elongated shell including a microwave dispersing chamber and a microwave transparent portion around said chamber, said shell being adapted for insertion into said opening, a microwave generating means, guide means for guiding microwaves from said microwave generating means into said microwave dispersing chamber a microwave mixer comprising a plurality of movable microwave deflecting blades positioned to intercept, deflect and disperse substantially all microwaves through the microwave transparent portion of said shell and substantially throughout the surrounding oil impregnated media adjacent said transparent portion of said shell said shell including a petroleum recovery chamber and a plurality of openings through said shell for communication of heated pertroleum from said media into said recovery chamber.

2. The apparatus of claim 1 wherein said microwave dispersing chamber and microwave transparent portion are disposed at the leading end of said shell.

3. The apparatus of claim 1 wherein said microwave generating means comprises a high voltage magnatron tube.

4. The apparatus of claim 3 wherein said magnatron tube is positioned within said shell and further comprising an electrical conduit means extended from said tube outwardly through the trailing end of said shell.

5. The apparatus of claim 3 wherein said guide means comprises a tube extended from said high voltage magnatron tube into said microwave dispersing chamber.

6. The apparatus of claim 1 wherein said petroleum recovery chamber is positioned adjacent the trailing end of said shell.

* * * * *